United States Patent [19]

Hori

[11] Patent Number: 4,973,180

[45] Date of Patent: Nov. 27, 1990

[54] PEN WITH SLIDE PLUG AND VALVE

[76] Inventor: Jiro Hori, 61-2, Ooazakamihiroya, Tsurugashima-machi, Iruma-gun, Saitama-ken, Japan

[21] Appl. No.: 357,624

[22] Filed: May 25, 1989

Related U.S. Application Data

[63] Continuation of Ser. No. 35,186, Apr. 7, 1987, abandoned.

[30] Foreign Application Priority Data

Apr. 10, 1986 [JP] Japan ..... 61-82535
Aug. 7, 1986 [JP] Japan ..... 61-185654

[51] Int. Cl.[5] ..... B43K 7/10; B43K 8/04; B43K 5/18

[52] U.S. Cl. ..... 401/141; 401/151; 401/198; 401/205; 401/230; 401/232; 401/209

[58] Field of Search ..... 401/198, 141, 151, 230, 401/232, 236, 237, 205, 209, 141

[56] References Cited

U.S. PATENT DOCUMENTS

| | | | |
|---|---|---|---|
| 1,661,746 | 3/1928 | Caldwell | 401/230 X |
| 2,099,891 | 11/1937 | Johannesson | 401/232 |
| 2,211,312 | 8/1940 | Barlow et al. | 401/151 |
| 2,435,123 | 1/1948 | Biro | 401/230 X |
| 2,762,337 | 9/1956 | Beckwith . | |
| 3,397,939 | 8/1968 | Berry . | |

FOREIGN PATENT DOCUMENTS

| | | | |
|---|---|---|---|
| 181798 | 9/1954 | Austria | 401/151 |
| 152754 | 7/1904 | Fed. Rep. of Germany | 401/230 |
| 58110 | 9/1953 | France | 401/141 |
| 1038640 | 9/1953 | France . | |
| 1119732 | 6/1956 | France | 401/232 |
| 1306685 | 9/1962 | France | 401/230 |
| 695357 | 8/1953 | United Kingdom | 401/151 |

*Primary Examiner*—Steven A. Bratlie
*Attorney, Agent, or Firm*—Oblon, Spivak, McClelland, Maier & Neustadt

[57] ABSTRACT

A tool for applying a liquid to a predetermined portion is disclosed. The tool has a main ink reservoir and a sub-ink reservoir. The sub-ink reservoir communicates with a pen body. The main ink reservoir communicates with the sub-ink reservoir through a valve mechanism. When ink inside the sub-ink reservoir is depleted upon writing, and a pressure inside the sub-ink reservoir is reduced, the valve mechanism is opened.

4 Claims, 8 Drawing Sheets

PEN WITH SLIDE PLUG AND VALVE

This application is a Continuation of application Ser. No. 07/035,186, filed on Apr. 7, 1987, now abandoned.

BACKGROUND OF THE INVENTION

1. Field of the Invention

The present invention relates to an improvement of an apparatus for applying a liquid material onto a predetermined portion, such as a pen (e.g., a ballpoint pen, a felt-tip pen, and the like) using a water-base ink or other types of ink, or a tool for applying cosmetics or medicines, and the like. More specifically, the present invention relates to a pen storing a water-base ink, such as a ballpoint pen, a felt-tip pen, and the like, that can store a large quantity of water-base ink, can satisfactorily control a quantity of ink to be supplied, and can reliably prevent scratching without ink and ink dripping caused by changes in temperature, atmospheric pressure, and the like.

2. Prior Art

Recently, ballpoint pens, felt-tip pens, and the like employing a water-base ink have been widely used.

In these conventional ballpoint pens, a fibrous member such as cotton is filled in an ink reservoir in a cylindrical casing, and is impregnated with ink. For this reason, only a small quantity of ink can be held. Since a small quantity of ink is supplied to a writing tip of the ballpoint pen or felt-tip pen, if a user writes fast, the ink is not often applied to the predetermined portion.

In order to eliminate these drawbacks, some pens store liquid ink directly in their cylindrical casings. However, in these pens, as the ink in an ink reservoir is consumed, air must be accordingly introduced therein. However, with this structure, the air in the ink reservoir expands due to changes in temperature, atmospheric pressure, and the like, thus easily causing dripping from a writing tip.

In some pens, an elongated, cylindrical, ink reservoir is used to store an ink therein, and a slidable plug, which slides to keep a liquid-tight seal, is inserted in the ink reservoir, to separate the ink from air in the ink reservoir and to communicate the air therein with outer air. As the ink is consumed, the slidable plug slides.

With this structure, a large quantity of ink can be stored, and ink dripping due to expanded air can be prevented. For example, in the case of a ballpoint pen using a water-base ink, a suction pressure, with which a writing tip draws the internal ink upon writing, corresponds to a pressure head of about 200 mm. Therefore, a slide resistance of the slidable plug must be set in a range below a pressure head of 200 mm. If the slide resistance of the slidable plug increases, a large pressure difference must be generated between the ink and air so as to move the slidable plug. For this reason, if the ink expands due to a change in temperature, a pressure of the ink portion becomes higher than the atmospheric pressure. Contrary to this, if the ink portion shrinks due to a change in temperature, the pressure of the ink portion becomes lower than the atmospheric pressure. For these reasons, in a pen having the slidable plug, dripping may occur, or air is drawn from the writing tip and writing fails to perform due to ink shortage. If such a pen falls on a floor or a desk, an instantaneous pressure difference is caused in the ink portion due to inertia acting thereon, and similar drawbacks to the above occur. In order to eliminate these drawbacks, the slide resistance of the slidable plug is so increased as to cancel the inertia acting on the ink portion. For this purpose, the slide resistance of the slidable plug must be accurately determined. However, it is difficult to accurately control the slide resistance of the slidable plug, and the structure of the slidable plug becomes complicated.

In the pen having the slidable plug, a mechanism for accurately controlling the flow rate of ink supplied to a writing tip must be added.

As the conventional ink-supply flow rate control mechanism, a fibrous core, as hardened fibers, is used. In this mechanism, the ink is supplied to the writing tip by a capillary attraction of the fibrous core, and excessive ink supply can be prevented by the flow resistance in the fibrous core. The flow rate of the ink is controlled by a density of the fibrous core.

However, with this mechanism, a flow rate of ink cannot be reliably controlled, and ink dripping or scratching without an ink, i.e., scratchy writing due to insufficient ink, cannot be satisfactorily prevented.

SUMMARY OF THE INVENTION

It is an object of the present invention to provide a pen which comprises a slidable plug, is capable of storing a large quantity of ink, and can reliably control ink supply to a writing tip.

According to the present invention, a large-capacity main ink reservoir for storing a liquid material such as an ink is formed in a cylindrical casing, a sub-ink reservoir is formed between the main ink reservoir and the writing tip, and a valve mechanism is arranged between the main ink reservoir and the sub-ink reservoir. The valve mechanism allows the ink to flow from the main ink reservoir to the sub-ink reservoir when a pressure in the sub-ink reservoir decreases due to a predetermined pressure difference smaller than an ink suction pressure of the writing tip.

In this structure, when the ink inside the sub-ink reservoir is consumed upon writing, and the pressure in the sub-ink reservoir is decreased, the valve mechanism is opened, thus supplying the ink from the main ink reservoir to the sub-ink reservoir. Thus, the sub-ink reservoir can be kept filled with the ink. The slidable plug slides as the ink flows from the main ink reservoir and thus is used. If the ink expands or shrinks due to a change in temperature, the plug slides to compensate for this expansion or shrinkage. Although the ink inside the sub-ink reservoir also expands or shrinks, the absolute volume of expanded or shrunk ink portion is very small since the sub-ink reservoir has a small volume. Therefore, the ink in the sub-ink reservoir cannot be pushed out from the pen body, or no air can be taken in from the writing tip. When the pen of this type is dropped while the pen body faces upward, a low pressure state instantaneously occurs in the ink portion due to its shock. However, since the ink flow from the sub-ink reservoir to the main ink reservoir is shut off by the valve mechanism, no air can be taken in from the writing tip. Contrarily, if the pen is dropped while the writing tip faces downward, a high pressure state instantaneously occurs in the ink in the main ink reservoir due to its shock. However, this instantaneous high pressure can be absorbed by the valve mechanism. Therefore, only a small quantity of ink can flow from the main ink reservoir to the sub-ink reservoir, and neither ink can be pushed out nor dripped from the writing tip.

BRIEF DESCRIPTION OF THE DRAWINGS

The present invention will become apparent from the following detailed description of the preferred embodiments taken in conjunction with the accompanying drawings, in which:

FIGS. 1 to 3 show a first embodiment of the present invention, in which FIG. 1 is a longitudinal sectional view, FIG. 2 is a longitudinal sectional view of the main part, and FIG. 3 is a sectional view taken along line III—III in FIG. 2;

FIGS. 4 and 5 show a second embodiment of the present invention, in which FIG. 4 is a longitudinal sectional view of the main part, and FIG. 5 is a sectional view taken along line V—V in FIG. 4;

FIGS. 6 and 7 show a third embodiment of the present invention, in which FIG. 6 is a longitudinal sectional view of the main part, and FIG. 7 is a sectional view taken along line VII—VII in FIG. 6;

FIGS. 8 and 9 show a fourth embodiment of the present invention, in which FIG. 8 is a longitudinal sectional view of the main part, and FIG. 9 is a sectional view taken along line IX—IX in FIG. 8;

FIGS. 12 and 13 show a seventh embodiment of the present invention, in which FIG. 12 is a longitudinal sectional view of the main part, and FIG. 13 is a sectional view taken along line XIII—XIII in FIG. 12.

DETAILED DESCRIPTION OF THE PREFERRED EMBODIMENTS

A plurality of embodiments in which the present invention is applied to a ballpoint pen using a waterbase ink will be described hereinafter with reference to the accompanying drawings.

Figure 1:
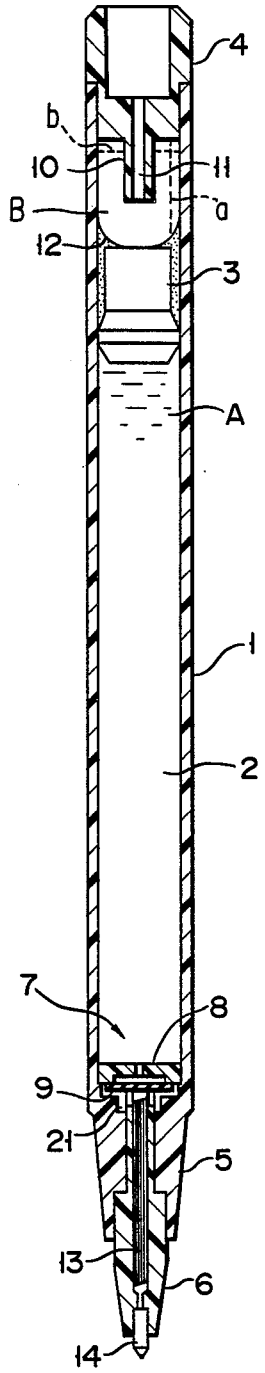
Figure 2:
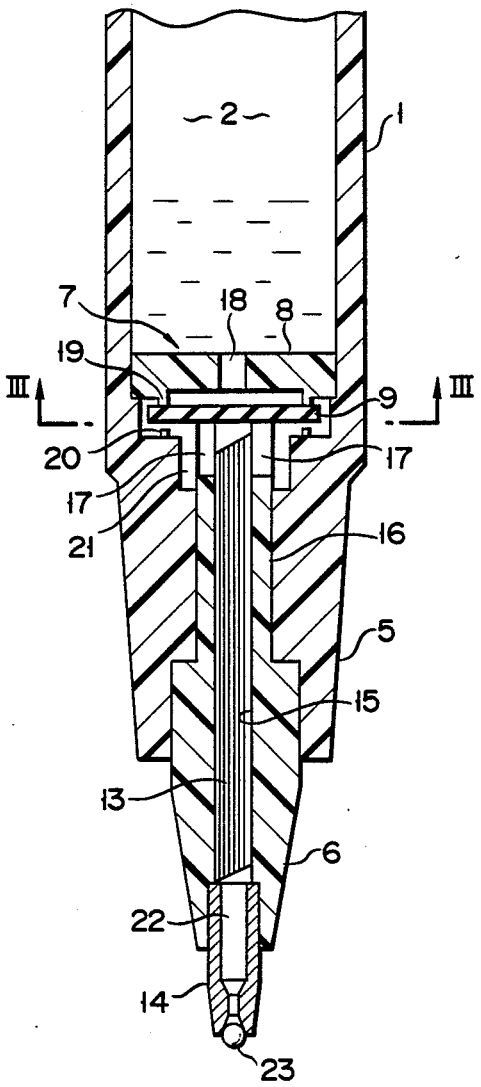
Figure 3:
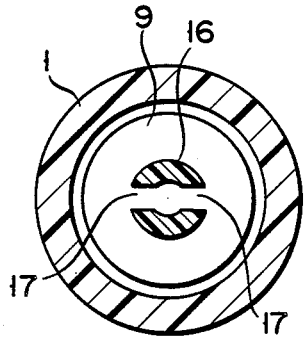

FIGS. 1 to 3 show a first embodiment of the present invention. In FIGS. 1 to 3, reference numeral 1 denotes a cylindrical casing. Elongated cylindrical main ink reservoir 2 is formed in cylindrical casing 1. Main ink reservoir 2 utilizes entire cylindrical casing 1, and has a much larger volume (e.g., about 3 cc) than that of a conventional ink reservoir. Water-base ink A is filled in main ink reservoir 2. Slidable plug 3 consisting of an elastic material such as silicone rubber is slidably inserted in main ink reservoir 2, and separates ink A from an air portion B in reservoir 2. Slidable plug 3 is slidably moved to follow ink consumption, expansion, or shrinkage due to a change in temperature.

Tail plug 4 is fitted in the rear end portion of the casing. A small quantity of sealing liquid 12 such as silicone oil is sealed in a portion between tail plug 4 and slidable plug 3, i.e., in an air portion. Sealing liquid 12 provides a seal for slidable plug 3 and makes slidable movement of slidable plug 3 smooth. Projection 10 projects from the central portion of the inner surface of tail plug 4. Air communication hole 11 is formed in tail plug 4, and the air portion in main ink reservoir 2 communicates with outer air through communication hole 11. The length of projection 10 is sufficient, so as to prevent sealing liquid 12 from leaking from communication hole 11. More specifically, since sealing liquid 12 has a relatively high viscosity, it flows along a wall surface even if the position of the pen changes. If the pen is horizontally held, sealing liquid 12 flows along the wall surface, and is stored in a portion, as indicated by a in FIG. 1. When the pen is vertically held while tail plug 4 faces downward, sealing liquid 12 is stored in a portion, as indicated by b in FIG. 1. Therefore, if projection 10 has a sufficient projecting length in terms of a quantity of sealing liquid 12, sealing liquid 12 will not reach the opening of communication hole 11 even if the pen is in any posture. Therefore, sealing liquid 12 cannot leak from communication hole 11.

Writing tip holder 6 is arranged on the distal end portion of cylindrical casing 1. Ballpoint writing tip 14 is mounted on the distal end portion of holder 6. Ball 23 is rotatably fitted in the distal end of writing tip 14.

Valve mechanism 7 is arranged inside the distal end portion of cylindrical casing 1. Valve mechanism 7 defines sub-ink reservoir 21 having a small volume in the distal end portion of cylindrical casing 1.

Valve mechanism 7 is arranged as shown in FIGS. 2 and 3. More specifically, reference numeral 8 denotes a valve seat member. Valve seat member 8 has a disk-like shape and is fitted in the distal end portion of cylindrical casing 1 under pressure. Through hole 18 is formed in the central portion of valve seat member 8. Annular valve seat portion 19 is formed on the periphery of the surface of member 8 on the side of the writing tip. Valve body 9 is arranged on valve seat member 8 on the side of the writing tip. Valve body 9 has a disk-like shape and is formed of an elastic material such as silicone rubber. Cylindrical compression projection 16 projects from writing tip holder 6. The distal end portion of projection 16 abuts against the central portion of valve body 9 and presses valve body 9 against valve seat portion 19 of valve seat member 8 at a predetermined pressure. Annular valve seat portion 20 also projects from the inner surface of the distal end portion of cylindrical casing 1. Valve seat portion 20 faces valve body 9 from the writing tip side of valve body 9 to form a small gap therebetween.

Ink feed hole 15 is formed in the central portion of the writing tip holder. Ink transport core 13 consisting of a porous material such as felt is inserted in ink feed hole 15 under pressure. Note that communication groove 17 is formed in the distal end portion of projection 16, so that sub-ink reservoir 21 communicates with ink feed hole 15.

The above-mentioned ink transport core is also utilized for adjusting a flow rate of ink to be supplied in the conventional pen. In the conventional ink transport core, its distal end portion is precisely molded to have a conical shape, and the conical distal end portion is brought into light contact with the ball of the pen body, thereby supplying ink to the ball. However, ink transport core 13 of this embodiment is not brought into contact with ball 23. Pen body ink reservoir 22 having a very small volume is formed between ink transport core 13 and ball 23, and ink is filled in ink reservoir 22.

The operation of the pen of the first embodiment will be described below. Ink A without air is filled in main ink reservoir 2, sub-ink reservoir 21, and writing tip ink reservoir 22. When the ink in reservoir 22 is depleted, the ink in sub-ink reservoir 21 is supplied to ink reservoir 22 via ink transport core 13. When the pressure in sub-ink reservoir 21 is decreased upon ink consumption therein, valve body 9 of valve mechanism 7 is elastically deformed and is separated from valve seat portion 19.

Thus, valve mechanism 7 is opened, and ink A in main ink reservoir 2 is supplied to sub-ink reservoir 21. Slidable plug 3 slides to follow ink consumption in main ink reservoir 2.

When the valve-opening pressure of valve mechanism 7, and a slide resistance of the slidable plug are appropriately set, the pen of this embodiment can reliably prevent ink dripping or scratching without ink due to a change in temperature or shock.

As described above, in the case of a ballpoint pen using a water-base ink, an ink suction pressure of the pen body upon writing corresponds to a pressure head of about 200 mm. In consideration of the dimensions of the main ink reservoir, a maximum volume is about 3 cc and a maximum length is about 75 mm due to the practical limitations on cylindrical casing 1. Therefore, when the pen is subjected to writing while the pen body faces upward, an ink suction pressure margin of pen body 14 corresponds to a pressure head of about 125 mm. Therefore, if a total of the slide resistance of slidable plug 3 and the valve-opening pressure of valve mechanism 7 is set to be 125 mm or lower, this pen can be used for upward writing. Of course, if upward writing is not taken into consideration, a total of the slide resistance of slidable plug 3 and the valve-opening pressure of valve mechanism 7 can be set to be larger than 125 mm.

When the ink in cylindrical casing 1 is expanded or shrunk due to a change in temperature, slidable plug 3 is slidably moved so as to compensate for it. In this case, the ink in sub-ink reservoir 21 and pen body ink reservoir 22 is also expanded or shrunk, since these reservoirs have very small volumes, the ink will not drip, or air will not be drawn from the pen body.

When the pen is dropped on a floor, a high or low pressure instantaneously occurs in main ink reservoir 2 due to the shock. However, since an instantaneous change in pressure is shut off or absorbed by the valve mechanism, a pressure in sub-ink reservoir 21 or pen body ink reservoir 22 is not changed. Therefore, ink dripping will not occur, and no air is drawn from the pen body.

Figure 4:
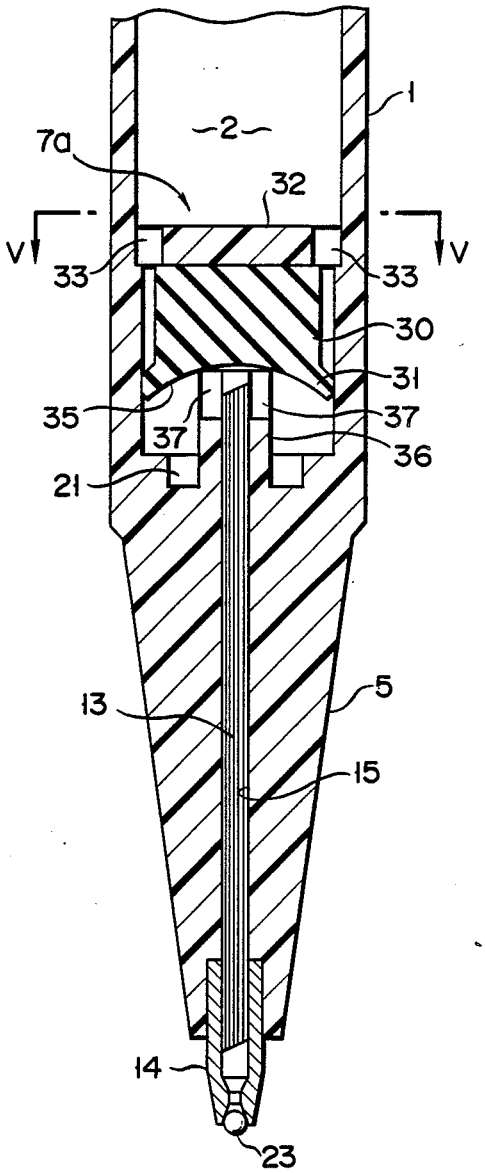
Figure 5:
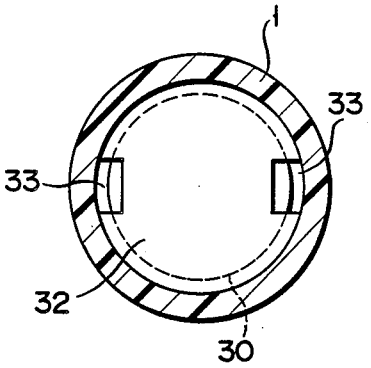

FIGS. 4 and 5 show a second embodiment of the present invention. This embodiment is substantially the same as the first embodiment, except for valve mechanism 7*a*. Valve mechanism 7*a* comprises valve body 30 consisting of an elastic material. Valve body 30 is preferably formed of silicone rubber. Annular valve seat portion 31 projects from the outer periphery of valve body 30 and is brought into tight contact with the inner surface of cylindrical casing 1. When a pressure difference between main ink reservoir 2 and sub-ink reservoir 21 exceeds a predetermined value, valve seat portion 31 is slightly deformed, and ink is supplied to sub-ink reservoir 21. The end face of valve body 30 on the side of the pen body has spherical surface 35. Stationary plate 32 is fitted in cylindrical casing 1 under pressure. Two ink communication grooves 33 are formed on the edge portion of stationary plate 32. Compression projection 36 projects from the cylindrical casing on the side of the writing tip. Communication groove 37 is also formed in the distal end portion of projection 36. Valve body 30 is clamped and fixed between stationary plate 32 and the distal end portion of projection 36.

The operation of the second embodiment is the same as that in the first embodiment. The pen of this embodiment is constituted by a smaller number of parts and can be easily manufactured at low cost. In the movement when the valve mechanism is opened, valve seat portion 31 of valve body 30 is slightly deformed. Therefore, the valve mechanism can be opened or closed to follow a small quantity of ink consumed upon writing.

Figure 6:
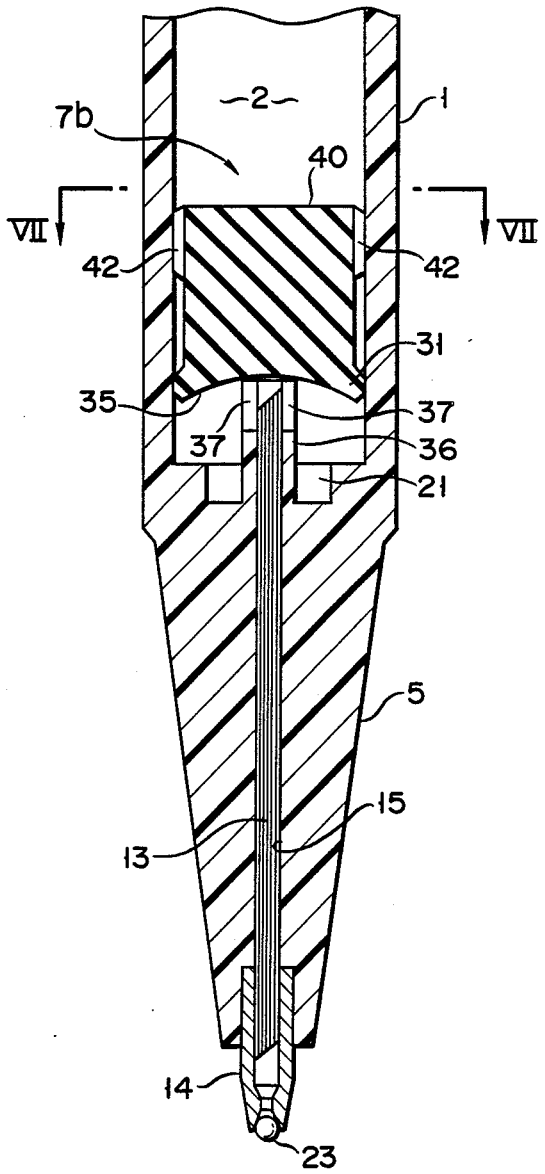
Figure 7:
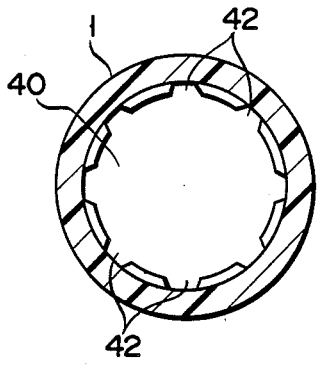

FIGS. 6 and 7 show a third embodiment of the present invention. In this embodiment, valve mechanism 7*b* has substantially the same valve body 40 as that in the second embodiment. The material and structure of valve body 40 are substantially the same as those of the second embodiment, except that a plurality of projections 42 are formed on its outer surface. Valve body 40 is fitted in cylindrical casing 1 under pressure. In this case, projections 42 are deformed to be brought into tight contact with the inner surface of cylindrical casing 1 and hold valve body 40 in a predetermined position. In the pen of this embodiment, a stationary plate as in the second embodiment is omitted. The pen of this embodiment has a still smaller number of parts than that of the second embodiment and can be easily manufactured at lower cost.

Figure 8:
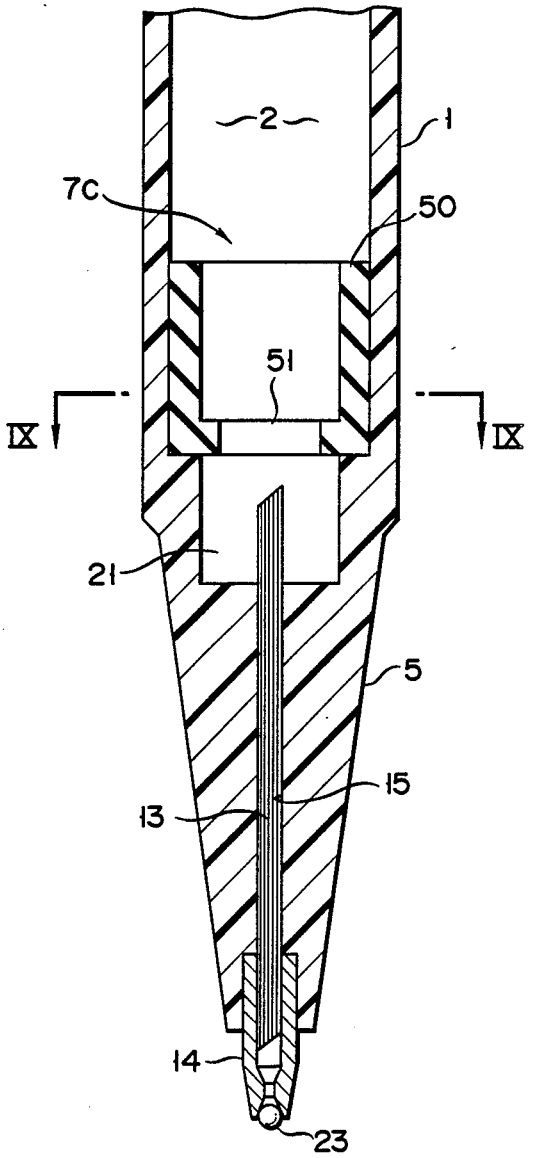
Figure 9:
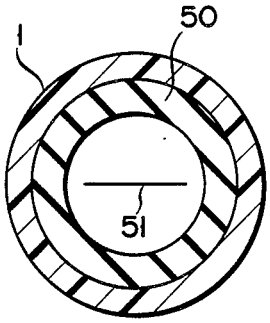

FIGS. 8 and 9 show a fourth embodiment of the present invention. In this embodiment, valve mechanism 7*c* comprises cup-shaped valve body 50 formed of an elastic material such as silicone rubber. Valve body 50 is fitted in main ink reservoir 2 under pressure, and is held in position. Notch 51 is formed in the bottom wall portion of valve body 50. When a predetermined pressure difference acts on valve body 50, notch 51 is opened, so that the ink is supplied from main ink reservoir 2 to sub-ink reservoir 21.

Figure 10:
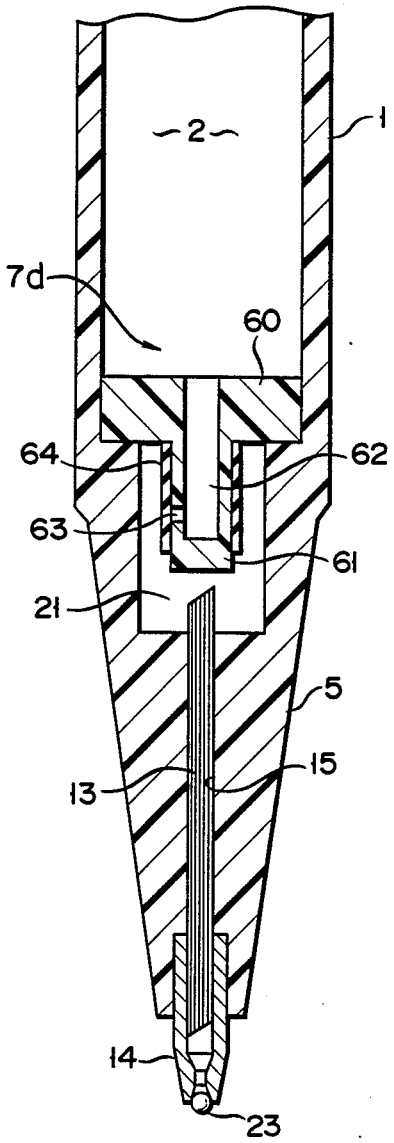
FIG. 10 is a longitudinal sectional view of the main part according to a fifth embodiment of the present invention.

FIG. 10 shows a fifth embodiment of the present invention. In this embodiment, valve mechanism 7*d* comprises valve seat member 60, which is fitted in main ink reservoir 2 under pressure. Cylindrical valve seat portion 61 projects from valve seat member 60. Communication hole 62 is formed in valve seat portion 61, and communication port 63 is open to the periphery of portion 61. Tubular valve body 64 formed of an elastic material such as silicone rubber is fitted on the outer periphery of valve seat portion 61. In the pen of this embodiment, ink flow from sub-ink reservoir 21 to main ink reservoir 2 is prevented by valve body 64. When a predetermined pressure difference occurs, the ink is supplied from main ink reservoir 2 to sub-ink reservoir 21.

Figure 11:
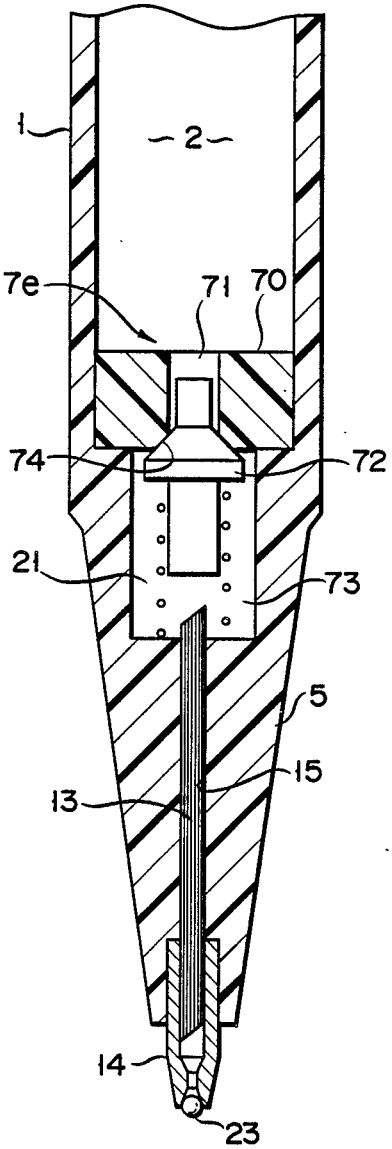
FIG. 11 is a longitudinal sectional view of the main part according to a sixth embodiment of the present invention.

FIG. 11 shows a sixth embodiment of the present invention. In this embodiment, valve mechanism 7*e* comprises valve seat member 70, which is fitted in main ink reservoir 2 under pressure. Communication hole 71 is formed in valve seat member 70, and the edge portion of hole 71 has a conical shape to define valve seat portion 74. Valve body 72 is mounted on valve seat portion 74 and is pressed thereagainst by spring 73 at a predetermined biasing pressure. In the pen of this embodiment, ink flow from sub-ink reservoir 21 to main ink reservoir 2 is prevented by valve body 72, and valve body 72 is opened when a predetermined pressure difference occurs.

Figure 12:
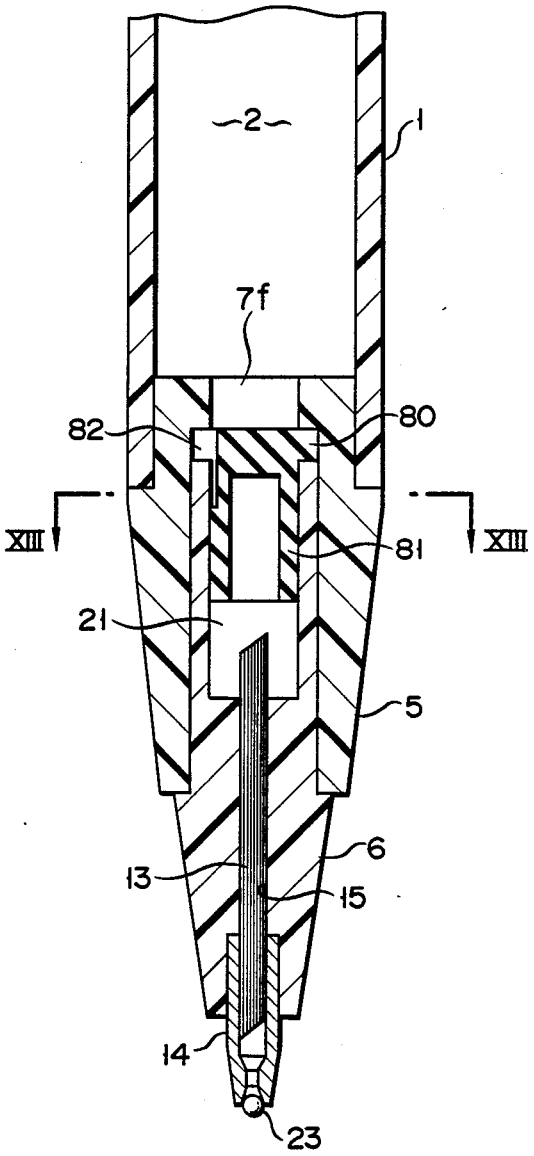
Figure 13:
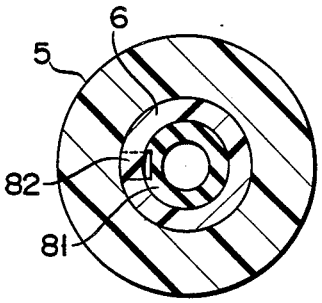

FIGS. 12 and 13 show a seventh embodiment of the present invention. In this embodiment, valve mechanism 7*f* has cylindrical valve body 80 formed of an elastic material such as silicone rubber. Valve body 80 is elastically fitted in sub-ink reservoir 21. Ink communication groove 82 is formed in valve body 80. In the pen of this embodiment, ink flow from sub-ink reservoir 21 to main ink reservoir 2 is prevented by valve body 80. When a predetermined pressure difference occurs, the ink is supplied through a gap between the outer surface of cylindrical portion 81 of valve body 80 and the inner surface of sub-ink reservoir 21.

Figure 14:
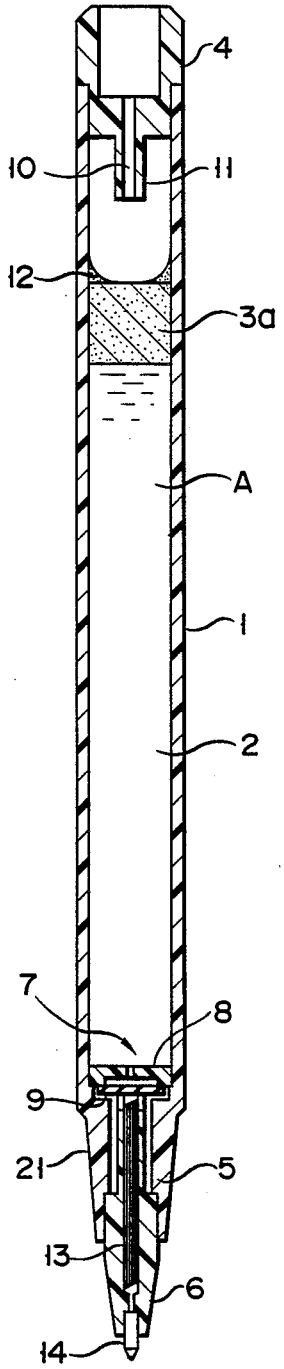
FIG. 14 is a longitudinal sectional view of an eighth embodiment of the present invention.

FIG. 14 shows an eighth embodiment of the present invention. In this embodiment, as in the above-mentioned slidable plug, slidable plug 3*a* consisting of a gel material such as gelatin or the like is slidably fitted in main ink reservoir 2. Slidable plug 3*a* consisting of the gel material has high flexibility, a good sealing property, and a small slide resistance. After ink A is filled, the gel material is supplied into main ink reservoir 2 and is gelled to form slidable plug 3*a*. Therefore, this can facilitate the manufacturing process, and can still reduce cost.

The above embodiments have substantially the same arrangements, except for the above-mentioned respects. The same reference numerals denote the same parts as in the first embodiment, and a detailed description thereof was omitted.

The present invention is not limited to the above embodiments. For example, the structure of the valve mechanism is not limited to those in the above embodiments.

The valve mechanism need not always have a check valve function for preventing ink flow from the sub-ink reservoir to the main ink reservoir. When the pen is dropped on a floor while the pen body faces upward, since a negative pressure produced in the main ink reservoir is very instantaneous, the negative pressure can be satisfactorily prevented by the resistance of the valve mechanism itself and the resistance of the ink transport core from acting on the writing tip.

The slidable plug is not limited to those described above. For example, the slidable plug can consist of an open- or closed-cell foamed elastic material.

The present invention is not limited to a waterbase ballpoint pen, but may be applied to various other pen bodies, such as a felt-tip pen body, a mohitsu writing tip, and the like.

What is claimed is:

1. Apparatus having a cylindrical casing and a writing tip provided on its forward end portion and adapted to supply liquid at a predetermined position, said writing tip producing a sucking pressure for sucking ink from inside the apparatus when used, said apparatus comprising:

a main ink reservoir formed within said cylindrical casing;

a slide plug slidably inserted within said main ink reservoir and separating ink within said main ink reservoir from air, said slide plug having a predetermined sliding resistance and being communicable with a sliding pressure sufficient for permitting the slide plug to slide in spite of the sliding resistance;

a sub ink reservoir having a small capacity and communicating with said writing tip; and a valve mechanism comprising means through which said main ink reservoir communicates with said sub ink reservoir and which includes a valve body, said valve mechanism being normally closed, and being opened when a differential pressure between the pressure in the main ink reservoir and the pressure in the sub ink reservoir becomes higher than a predetermined valve opening pressure, thereby supplying ink from the main ink reservoir into the sub ink reservoir, said sliding pressure of the slide plug and said valve opening pressure of the valve mechanism being determined such that their sum is smaller than the sucking pressure at the writing tip, wherein there is no air in said sub ink reservoir.

2. Apparatus according to claim 1, wherein said valve body is formed of an elastic material and is cylindrical in configuration with an annular valve seat projecting on an outer periphery of said cylindrical valve body, and said valve seat intimately coacts with the inner wall of said cylindrical casing to function as a valve, said valve body being normally urged to a closed position by an elastic force of said valve body and said valve seat.

3. Apparatus according to claim 2, wherein said valve body has a plurality of projections on its outer periphery, said projections being elastically deformed into close contact with said inner wall of said cylindrical casing, whereby said valve body is held in a predetermined position.

4. Apparatus according to claim 1, wherein the sum of the sliding pressure of the slide plug and the valve opening pressure of the valve mechanism is smaller than a value obtained by subtracting an ink head pressure corresponding to the axial length of an ink-filled region of the main ink reservoir from the sucking pressure at the writing tip.

* * * * *